US005309743A

United States Patent [19]

Kokubu et al.

[11] Patent Number: 5,309,743

[45] Date of Patent: May 10, 1994

[54] DOOR UNLOCKING DEVICE

[75] Inventors: Sadao Kokubu; Hisashi Aoki; Yoshiyuki Mizuno, all of Aichi, Japan

[73] Assignee: Kabushiki Kaisha Tokai Rika Denki Seisakusho, Aichi, Japan

[21] Appl. No.: 914,354

[22] Filed: Jul. 17, 1992

[30] Foreign Application Priority Data

Jul. 23, 1991 [JP] Japan ..... 3-206405

[51] Int. Cl.[5] ..... E05B 65/20

[52] U.S. Cl. ..... 70/257; 70/264; 70/265; 70/278; 70/279; 70/427; 70/430; 307/10.1; 340/825.31; 361/172

[58] Field of Search ..... 70/427, DIG. 30, 257, 70/278, 279, 237, 264, 265; 340/825.31; 361/172; 307/10.1

[56] References Cited

U.S. PATENT DOCUMENTS

| | | | |
|---|---|---|---|
| 2,996,910 | 8/1961 | Willis | 70/264 |
| 3,797,004 | 3/1974 | Muessel et al. | 70/DIG. 49 X |
| 4,671,090 | 6/1987 | Masaki et al. | 70/423 X |
| 4,734,693 | 3/1988 | Dluhosch et al. | 70/278 X |
| 4,805,427 | 2/1989 | Bates et al. | 70/264 |
| 4,827,744 | 5/1989 | Namazue et al. | 70/252 |
| 4,868,409 | 9/1989 | Tanaka et al. | 70/278 X |
| 4,895,009 | 1/1990 | Kleefeldt et al. | 70/264 |
| 4,910,980 | 3/1990 | Katoh | 70/264 X |
| 5,168,733 | 12/1992 | Rathmann et al. | 70/264 |
| 5,220,319 | 6/1993 | Kendel | 70/456 R X |

FOREIGN PATENT DOCUMENTS

| | | | |
|---|---|---|---|
| 3613560A1 | 10/1987 | Fed. Rep. of Germany . | |
| 3613561A1 | 10/1987 | Fed. Rep. of Germany . | |
| 3617382A1 | 11/1987 | Fed. Rep. of Germany . | |
| 3820248A1 | 1/1989 | Fed. Rep. of Germany . | |
| 2597537 | 10/1987 | France | 70/257 |

*Primary Examiner*—Lloyd A. Gall

*Attorney, Agent, or Firm*—Finnegan, Henderson Farabow, Garrett & Dunner

[57] ABSTRACT

An object of this invention is to provide a door unlocking device adapted unlock a door by transmitting a signal in the air through a signal transmitter, which can unlock the door even when the power source of the signal transmitter, namely, the battery has consumed up. With a door unlocking device, upon insertion of an ignition key into the rotor of a key cylinder, a shutter is opened to operate a shutter switch. Under this condition, the rotor is turned in opposite directions from the neutral position according to a predetermined rotor turning pattern. The rotor turning pattern is discriminated by a rotor-turning-pattern discriminating circuit. Ensuring that the rotor turning pattern is the one predetermined for unlocking the door, the rotor-turning-pattern discriminating circuit activates an electric operating mechanism to cause a lock mechanism to unlock the door.

10 Claims, 2 Drawing Sheets

DOOR UNLOCKING DEVICE

BACKGROUND OF THE INVENTION

This invention relates to a device for unlocking the door of a motor vehicle or the like, and more particularly to a door unlocking device having a door unlocking mechanism which automatically unlocks a door in response to a signal which the user transmits through a signal transmitter or the like.

Recently some motor vehicles have been equipped with a so-called wireless door lock device which is designed for instance as follows: An ignition key is provided with a signal transmitter. The transmitter is operated by the operator to transmit a radio wave signal (propagating in the air), which is detected by received signal discriminating means provided on the vehicle body. When it is determined that the radio wave signal is the one predetermined for the door of the motor vehicle, an electric actuator is operated to automatically lock or unlock the door.

In general, the transmitter is operated on a battery. When, the transmitter being used for a long time, the power of the battery is consumed up, it becomes impossible to operate the transmitter to transmit the radio wave signal; that is, it becomes impossible to unlock the door.

In another example of the conventional door unlocking device, an ignition key has a number of small holes, and a light emitting and receiving device is provided on the side of the key cylinder. When the ignition key is inserted into the key cylinder, light passed through the small holes of the ignition key is utilized to output a signal. When it is determined that the signal is the one predetermined for unlocking the door, the door lock is opened. However, the door unlocking device is still disadvantageous in that, when the device is used for a long time, the small holes of the ignition key may be deformed or collapsed, so that the predetermined signal cannot be provided; that is, the door cannot be unlocked.

SUMMARY OF THE INVENTION

In view of the foregoing, an object of this invention is to provide a door unlocking device in which, even when it becomes impossible for the unlocking signal generating means to produce the Output signal, the operation of the key cylinder causes the electric actuator in the electric operating mechanism to operate to unlock the door.

The foregoing object of the invention has been achieved by the provision of a door unlocking device comprising: an electric operating mechanism with an electric actuator which performs an unlocking operation to cause a lock mechanism to operate to unlock a door; and receiving signal discriminating means for causing, when a signal received thereby is the one predetermined for unlocking the door, the electric actuator of the electric operating mechanism to perform the unlocking operation; detecting means for detecting the insertion of a key into a rotor; signal generating means for producing a first signal when the rotor is turned in one direction from the neutral position, and a second signal when the rotor is turned in the other direction from the neutral position; and rotor-turning-pattern discriminating means for causing the electric actuator of the electric operating mechanism to perform the unlocking operation when the first and second signals produced by the signal generating means while the insertion of the key is being detected by the detecting means are of a rotor turning pattern predetermined for unlocking the door.

In the case where the unlocking signal generating means produces no output signal for some reason, the rotor is turned in both directions with the key inserted into the key cylinder. When it is determined that the rotor turning pattern is the one predetermined for unlocking the door, the rotor-turning-pattern discriminating means causes the electric actuator of the electric operating mechanism to perform the unlocking operation, to unlock the door.

BRIEF DESCRIPTION OF THE DRAWINGS

FIG. 2 (*b*) is a schematic representation for an electric operating mechanism of the present invention;

DETAILED DESCRIPTION OF THE PREFERRED EMBODIMENT

One embodiment of this invention, which is applied to a motor vehicle, will be described with reference to the accompanying drawings.

Figure 2A:
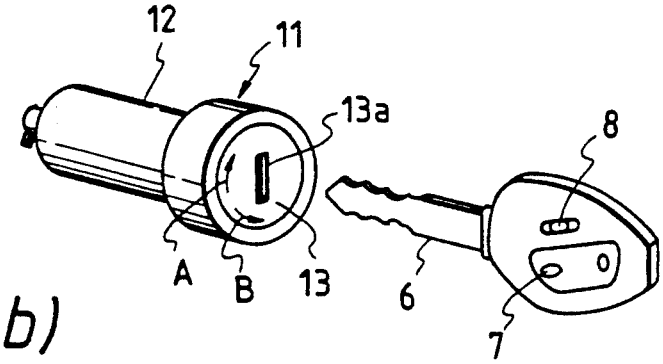
FIG. 2 (*a*) is a perspective view of essential components of the device of the present invention.
Figure 2B:
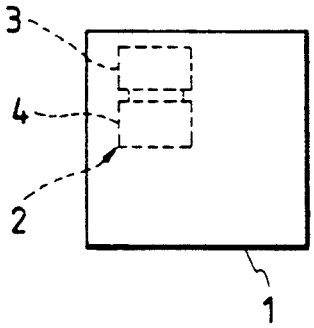

In FIG. 2 (*b*), reference numeral 1 designates a lock mechanism mounted on a door (not shown). When the lock mechanism 1 is given a locking displacement, it engages with a locking section on the side of the vehicle body, to lock the door; whereas when it is given an unlocking displacement, it unlocks the door. The lock mechanism is electrically operated.

In order to operate the lock mechanism electrically, an electric operating mechanism 2 is provided as shown in FIG. 2 (*b*). The electric operating mechanism 2 has electric actuators, namely, a locking electromagnet 3 and an unlocking electromagnet 4. When the locking electromagnet 3 is energized through a door locking and unlocking switch 5 (FIG. 1) mounted on the door beside the driver's seat, a movable iron core (not shown) is displaced and is attracted by the locking magnet 3, so that the lock mechanism 1 is given the locking displacement, to lock the door. When the unlocking electromagnet 4 is energized through the door locking and unlocking switch 5, the movable iron core is moved in the opposite direction and is attracted by the unlocking electromagnet 4, so that the lock mechanism 2 is given the unlocking displacement, to unlock the door.

Figure 1:
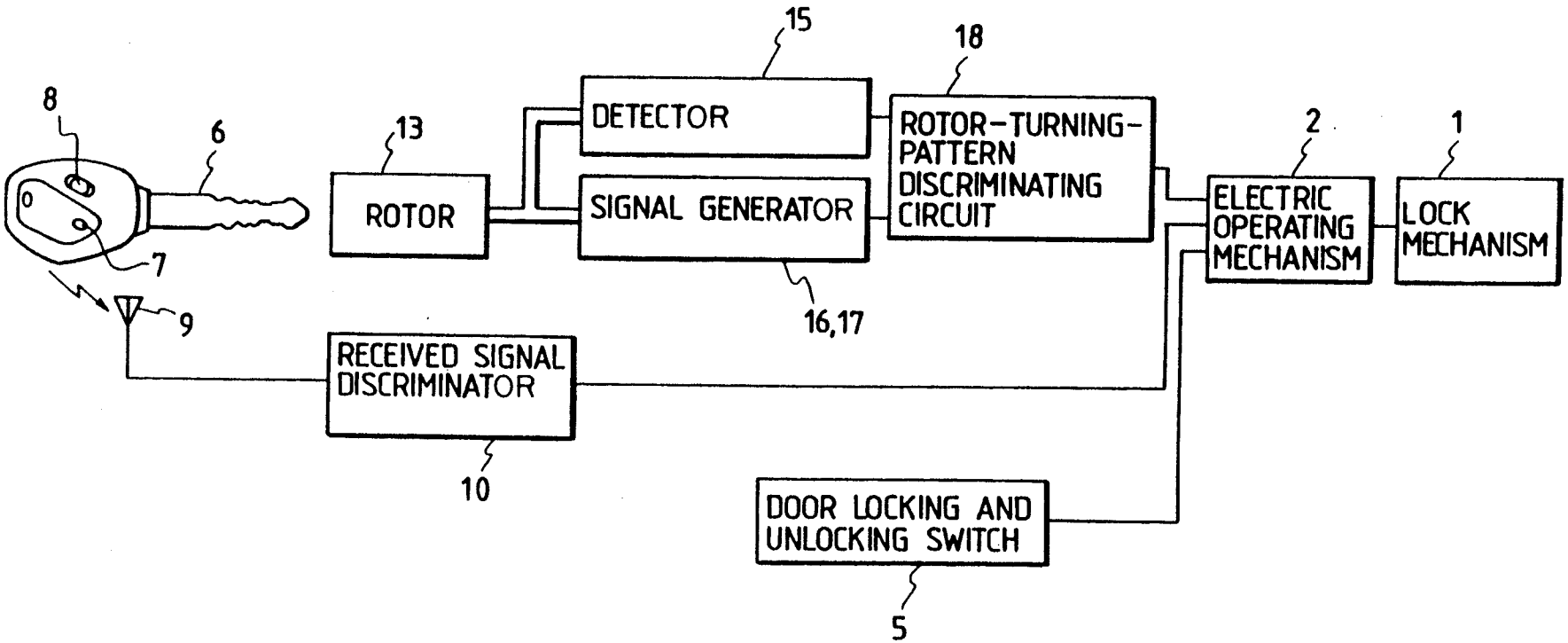
FIG. 1 is an explanatory diagram, partly as a block diagram, showing the mechanical and electrical arrangement of a door unlocking device, which constitutes one embodiment of this invention.

On the other hand, the ignition key 6 of the motor vehicle has unlocking signal generating means, namely, a signal transmitter (not shown), and a locking operating button 7 and an unlocking operating button 8 which are used to operate the transmitter. A battery (not shown) is built in the ignition key 6, and it is used as a power source of the transmitter. Upon operation of the operating button 7 (or 8), the transmitter is activated, so that a locking instruction (or an unlocking instruction) is transmitted in the form of a signal propagating in the air, such as a radio wave signal, from the ignition key 6. The radio wave signal is received by an antenna 9 installed on the motor vehicle as shown in FIG. 1. The radio wave signal is a code signal of several tens of bits. The code for the locking instruction is different in content from the code for the unlocking instruction. As for the locking instruction and the unlocking instruction, the codes are determined separately according to motor vehicles; that is, different codes are provided for different motor vehicles.

The radio wave signal received by the antenna is applied to received signal discriminating means, namely, a code discriminating circuit 10, where it is determined whether or not the code of the radio wave signal belongs to the motor vehicle, and it is also determined whether the code is of the locking instruction or whether it is of the unlocking instruction. When it is determined that the code belongs to the motor vehicle, and is of the locking instruction, the locking electromagnet 3 of the electric operating mechanism is energized to cause the lock mechanism 1 to operate to lock the door; whereas when it is determined that the code belongs to the motor vehicle, and is of the unlocking instruction, the unlocking electromagnet 4 is energized to cause the lock mechanism 1 to operate to unlock the door.

On the other hand, a key cylinder 11 as shown in FIG. 2 (*a*) is built in the door (not shown). The key cylinder 11 has a rotor casing 12, in which a rotor 13 is rotatably fitted. The ignition key 6 can be inserted into the rotor 13 through a key inserting inlet 13*a*.

Figure 3:
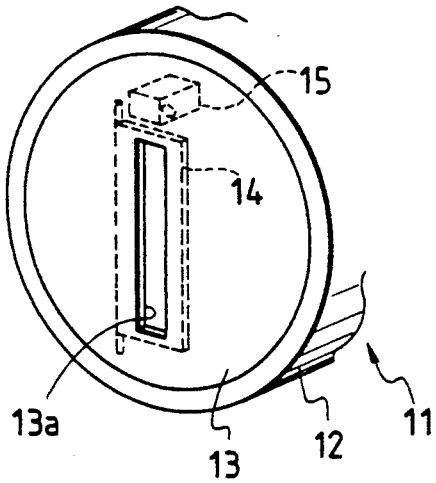
FIG. 3 is an enlarged perspective view for a description of the relation between a shutter provided for a rotor, and a switch provided inside the rotor.

In the electric operating mechanism 2, the unlocking electromagnet 4 is so designed that it is energized when the rotor 13 of the key cylinder is turned according to a rotor turning pattern which is predetermined for the motor vehicle. As shown in FIG. 3, a shutter 14 is provided at the key inserting inlet 13*a* of the rotor 13, in such a manner that it is opened as the ignition key 6 is inserted into the key inserting inlet. In addition, a detecting means, namely, a shutter switch 15, is provided which is operated in association of the opening of the shutter 14. That is, the shutter switch 15 is detecting means for detecting the insertion of the ignition key 6 into the rotor 13.

Figure 4:
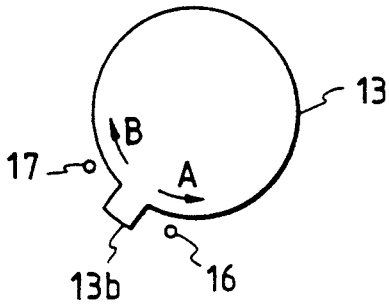
FIG. 4 is a diagram showing a switching structure for detecting a direction of rotation of the rotor.

As shown in FIG. 4, a protrusion 13*b* is extended from the rear end face of the rotor 13. The rotor casing 12 incorporates first signal generating means, namely, a forward rotation detecting switch 16 comprising a contactless switch for detecting the rotation of the rotor 13 in the forward direction of the arrow A from the neutral position, and second signal generating means, namely, a reverse rotation detecting switch 17 comprising a contactless switch for detecting the rotation of the rotor 13 in the reverse direction of the arrow B from the neutral position.

The detection signal of the shutter switch 15, and the detection signals of the forward rotation detecting switch 16 and the reverse rotation detecting switch 17, are applied to a rotor-turning-pattern discriminating circuit 18 (FIG. 1). While the shutter switch 15 is outputting its detection signal; that is, during the period of time which elapses from the time instant that the ignition key 6 is inserted into the rotor 13 until it is removed, the rotor-turning-pattern discriminating circuit 18 detects the order in which the forward rotation detecting switch 16 and the reverse rotation detecting switch 17 are operated, thereby to detect the pattern in which the rotor 13 is turned. When it is determined that the rotor turning pattern thus detected coincides with the one predetermined for the motor vehicle, the rotor-turning-pattern discriminating circuit 18 energizes the unlocking electromagnet 4 of the electric operating mechanism 2 to cause the lock mechanism 1 to operate to unlock the door.

The operation of the door unlocking device thus organized will be described.

When the operator, leaving his motor vehicle, has operated the locking operating button 7 of the ignition key 6 to lock the door, a locking instruction is transmitted, as a radio wave signal, from the ignition key 6. The radio wave signal is received by the antenna 9, and then applied to the code discriminating circuit 10. The code discriminating circuit 10 discriminates the radio wave signal. Ensuring that the radio wave signal is of the code predetermined for locking the door, the code discriminating circuit 10 operates to energize the locking electromagnet 3 of the electric operating mechanism 2, so that the lock mechanism 1 is given the locking displacement, thus locking the door.

In order to unlock the door to drive the motor vehicle, the unlocking operating button 8 on the ignition key 6 is operated. As a result, an unlocking instruction is issued, in the form of a radio wave signal, from the ignition key 6. Similarly as in the above-described case, the radio wave signal is applied through the antenna to the code discriminating circuit, where it is discriminated. Ensuring that the radio wave signal is of the code predetermined for unlocking the door, the code discriminating circuit 10 operates to energize the unlocking electromagnet 4 of the electric operating mechanism 2, so that the lock mechanism 1 is given the unlocking displacement, to unlock the door.

When the radio wave signal is not of the predetermined code, the code discriminating circuit 10 does not operate to energize the unlocking electromagnet 4. Hence, the lock mechanism 1 is not operated; that is, the door is held locked.

In the case where the transmitter on the ignition key 6 is used for a long period, its power source, namely, the battery may be consumed up. In this case, no radio wave signal can be transmitted from the ignition key, i.e., from the transmitter; that is, it is impossible to unlock the door with the radio wave signal. In this case, the device is operated as follows: The ignition key 6 is inserted into the rotor 13 of the key cylinder, and is then turned in the forward direction and in the reverse direction according to a predetermined rotor turning pattern, so that the forward rotation detecting switch 16 and the reverse rotation detecting switch 17 output the detection signals, which are applied to the rotor-turning-pattern discriminating circuit 18 to allow the latter 18 to decide a rotor turning pattern therefrom.

Ensuring that the rotor turning pattern is the one predetermined for unlocking the door, the rotor-turning-pattern discriminating circuit 18 operates to energize the unlocking electromagnet 4 of the electric operating mechanism 2 thereby to cause the lock mechanism 1 to unlock the door. Hence, even when the battery is consumed up; that is, even when no electric power is provided for the transmitter on the ignition key, the door can be unlocked by turning the rotor 13 according to the predetermined rotor turning pattern.

In the above-described embodiment, the signal propagating in the air is the radio wave signal; however, the invention is not limited thereto or thereby. That is, it may be an ultrasonic signal or an infrared signal. Furthermore, in the above-described embodiment, the unlocking signal generating means is the transmitter; however, it may be replaced by the following means: A number of small holes are formed in the ignition key, and a light emitting and receiving device is provided for the key cylinder, so that, when the ignition key is inserted into the key cylinder, a signal is produced in response to light passed through the small holes.

In addition, the functions of the code discriminating circuit 10 and the rotor-turning-pattern discriminating circuit 8 may be replaced by program control of a microcomputer.

While the invention has been described with reference to the embodiment shown in the accompanying drawings, it should be noted that the invention is not limited thereto or thereby, and it is obvious to those skilled in the art that various changes and modifications may be made therein without departing from the invention. For instance, the technical concept of the invention may be widely applied to devices for unlocking doors in general as well as the above-described motor vehicle door unlocking device.

As was described above, in the invention, it is detected in what pattern the rotor has been turned in the opposite directions during the period of time which elapses from the time instant that the ignition key is inserted into the rotor until it is removed therefrom, and when the rotor turning pattern thus detected is the one predetermined for unlocking the door, the electric actuator of the electric operating mechanism is operated to unlock the door. Hence, even when the unlocking signal generating means produces no unlocking signal, the door can be unlocked by turning the rotor with the ignition key in both directions according to the predetermined rotor turning pattern. This effect should be highly appreciated.

What is claimed is:

1. A door unlocking device comprising:

an electric operating mechanism responsive to a door-unlocking signal for unlocking a door;

a lock including a rotor casing and a rotor having a key inserting inlet corresponding to the door;

detecting means responsive to an insertion of a key into the key inserting inlet of the rotor for generating a key-detection signal;

signal generating means responsive to a forward rotation and a reverse rotation of the rotor for generating a rotor-turning-pattern signal; and rotor-turning-pattern discriminating means responsive to the generated rotor-turning-pattern signal and the generated key-detection signal for generating the door-unlocking signal for unlocking said door.

2. A door unlocking device as claimed in claim 1, wherein said signal generating means generates a first signal when said rotor is turned in one direction from a netural position, and generates a second signal when said rotor is turned in the other direction opposite to said one direction from said neutral position, wherein a sequence of a plurality of the generated first and second signals constitute the generated rotor-turning-pattern signal.

3. A door unlocking device as claimed in claim 2, wherein said signal generating means includes a forward rotation detecting switch and a reverse rotation detecting switch for generating the first and second signals.

4. A door unlocking device as claimed in claim 1, wherein said detecting means includes a shutter provided at the key inserting inlet of said rotor and a shutter switch operated in response to an opening of said shutter to generate the key-detection signal.

5. A door unlocking device as claimed in claim 1, wherein the rotor-turning-pattern discriminating means generates the door-unlocking signal when the generated rotor-turning-pattern signal corresponds to a predetermined rotor-turning-pattern signal.

6. A door unlocking device as claimed in claim 1, wherein the rotor-turning-pattern discriminating means only responds to the generated rotor-turing-pattern signal when the key-detection signal is generated.

7. A door unlocking device as claimed in claim 1, wherein the electric operating mechanism includes an electric actuator for performing an unlocking operation to cause a lock mechanism to unlock the door.

8. A door unlocking device as claimed in claim 1, wherein said electric operating mechanism is also responsive to a door-locking signal for locking the door, the device further including a received signal discrimination means responsive to a radio wave signal for generating the door-locking signal and alternatively generating the door-unlocking signal.

9. A door unlocking device comprising:

an electric operating mechanism responsive to a door-unlocking signal for unlocking a door;

a lock including a rotor casing and a rotor having a key inserting inlet corresponding to the door;

detecting means responsive to an insertion of a key into the key inserting inlet of the rotor for generating a key-detection signal and further including a shutter provided at the key inserting inlet and a shutter switch operated in response to an opening of said shutter to generate the key-detection signal;

signal generating means responsive to a forward rotation and a reverse rotation of the rotor for generating a rotor-turning-pattern signal; and rotor-turning-pattern discriminating means responsive to the generated rotor-turning-pattern signal and the generated key-detection signal for generating the door-unlocking signal for unlocking said door.

10. A door unlocking device comprising:

an electric operating mechanism responsive to a door-unlocking signal for unlocking a door and also responsive to a door-unlocking signal for locking the door;

received signal discrimination means responsive to a radio wave signal for generating the door-locking signal and, alternatively, the door-unlocking signal;

a lock including a rotor casing and a rotor having a key inserting inlet corresponding to the door;

detecting means responsive to an insertion of a key into the key inserting inlet of the rotor for generating a key-detection signal;

signal generating means responsive to a forward rotation and a reverse rotation of the rotor for generating a rotor-turning-pattern signal; and rotor-turning-pattern discriminating means responsive to the generated rotor-turning-pattern signal and the generated key-detection signal for generating the door-unlocking signal or unlocking said door.

* * * * *

UNITED STATES PATENT AND TRADEMARK OFFICE

CERTIFICATE OF CORRECTION

PATENT NO. : 5,309,743

DATED : May 10, 1994

INVENTOR(S) : Sadao Kokubu et al.

It is certified that error appears in the above-indentified patent and that said Letters Patent is hereby corrected as shown below:

On title page, "Attorney, Agent or Firm" after "Henderson" insert --,--.

Abstract, page 1, line 2, after "adapted" insert --to--.

Claim 2, column 5, line 60, change "netural" to ——neutral—.

Claim 6, column 6, line 15, change "turing" to --turning--.

Claim 10, column 6, line 66, change "or" to --for--.

Signed and Sealed this

Thirty-first Day of January, 1995

*Attest:*

*Attesting Officer*

Bruce Lehman

BRUCE LEHMAN

*Commissioner of Patents and Trademarks*